US006516477B1

(12) United States Patent
Storm

(10) Patent No.: US 6,516,477 B1
(45) Date of Patent: Feb. 11, 2003

(54) SHOWER APPARATUS FOR SEATED OCCUPANT

(76) Inventor: David B. Storm, 534 E. Broad St., Cookeville, TN (US) 38501

( * ) Notice: Subject to any disclaimer, the term of this patent is extended or adjusted under 35 U.S.C. 154(b) by 0 days.

(21) Appl. No.: 10/104,969

(22) Filed: Mar. 22, 2002

(51) Int. Cl.[7] ..... A47K 3/022
(52) U.S. Cl. ..... 4/604; 4/555; 4/665
(58) Field of Search ..... 4/555, 556, 589, 4/590, 604, 664, 665, 661, 663

(56) References Cited

U.S. PATENT DOCUMENTS

| | | | | |
|---|---|---|---|---|
| 1,728,132 | A | * | 9/1929 | Norton |
| 3,562,821 | A | | 2/1971 | Queen |
| 3,616,467 | A | | 11/1971 | Drain |
| 3,711,872 | A | * | 1/1973 | Jarosinski |
| 3,900,902 | A | * | 8/1975 | Jarosinski |
| 4,099,272 | A | | 7/1978 | Sowder |
| 4,112,524 | A | * | 9/1978 | Johansson |
| 4,118,810 | A | | 10/1978 | Brickhouse et al. |
| 4,160,292 | A | | 7/1979 | Kuether et al. |
| 4,287,619 | A | | 9/1981 | Brewer et al. |
| 4,680,817 | A | | 7/1987 | Sloan et al. |
| 4,796,312 | A | * | 1/1989 | Corlew |
| 4,974,268 | A | | 12/1990 | Cors et al. |
| 5,813,062 | A | | 9/1998 | Vago et al. |
| 5,978,983 | A | | 11/1999 | Queen et al. |

OTHER PUBLICATIONS

Arjo Inc., Shower Cabinet, (Brochure).
IPU Innovative Products Unlimited Inc., Bariatric Healthcare Equipment 700 lbs. Capacity (Brochure).

* cited by examiner

*Primary Examiner*—Charles R. Eloshway
(74) *Attorney, Agent, or Firm*—Luedeka, Neely & Graham, P.C.

(57) ABSTRACT

A shower apparatus for a seated occupant includes a tub having a body compartment for receiving the torso of an occupant in a seated position and a foot compartment for receiving the feet of the seated occupant. A seat is provided with a through opening positionable over a through opening in the bottom of the body compartment, both through openings being positionable over the bowl of a stationary floor toilet. A shower head/sprayer is provided to introduce a flow of water into the tub for showering the seated occupant. The shower head/sprayer is attached to one end of a water conduit with the other end of the water conduit having a fitting for attaching the conduit to a source of water, such as an existing faucet. Water is drained from the body compartment by gravity feed through the body compartment through opening and into the toilet bowl. Water is drained from the foot compartment by use of a pump which moves the water along a pump conduit and into the toilet bowl. An on-board battery may be employed to provide electrical power to operate the pump. Alternatively, electrical power for the pump may be obtained from an existing wall outlet. The apparatus can be set on wheels to facilitate movement of the apparatus.

30 Claims, 4 Drawing Sheets

SHOWER APPARATUS FOR SEATED OCCUPANT

FIELD OF THE INVENTION

The present invention relates generally to hygienic care devices for individuals needing hygienic care assistance. More particularly, the present invention relates to a bathing/shower apparatus that allows an assistant to bathe/shower an occupant seated in the apparatus.

BACKGROUND OF THE INVENTION

In a typical long-term care facility for the elderly and disabled, there is a central bathing or showering area where the residents are brought for daily showers. Prior to being transferred to the central bath area, an assistant typically prepares the resident for transport by disrobing the resident in their room and placing the resident in a shower chair having wheels. The naked resident is then draped with a blanket or other covering material and wheeled to the bathing area. This creates a less than dignified experience as the disrobed individual is transported past onlookers. During transport, it is common for incontinent accidents to occur, which further exacerbates an already difficult situation for the residents, staff, and visitors. Incontinent accidents also frequently occur when the resident gets into the bathing device and warm water causes relaxation of the body.

What is needed, therefore, is a shower apparatus for individuals in long term care facilities that eliminates indignities and/or other problems associated with current bath/shower devices.

SUMMARY OF THE INVENTION

The present invention eliminates the difficulties and disadvantages of the prior art by providing a shower apparatus for a seated occupant having a tub with a plurality of upstanding sides and a tub bottom. The tub includes a body compartment for receiving the torso of an occupant in a seated position. The body compartment bottom, which defines a first portion of the tub bottom, includes a through opening positionable over the bowl of a stationary floor toilet. The tub also includes a foot compartment for receiving the feet of the occupant. The foot compartment bottom, which defines a second portion of the tub bottom, is at a level below the top of the toilet bowl. A seat is provided for receiving the occupant in a seated position. The seat includes a through opening positionable above the through opening in the body compartment bottom. Means are also provided for moving water from the foot compartment into the toilet bowl.

In accordance with one aspect of the invention, the means for moving water from the foot compartment into the toilet bowl includes a drain opening positioned within the foot compartment for draining water from the foot compartment by gravity feed into a sump. A pump moves water out of the sump and into the toilet bowl via a pump conduit connected to the pump outlet. In an alternate embodiment, the means for moving includes a pump which moves water along a drain conduit having a first end in fluid communication with the foot compartment and a second end positioned adjacent the toilet bowl.

Means for introducing a flow of water into the tub are also provided. In a preferred embodiment, the means for introducing a flow of water includes a water conduit having an end fitting for attachment of the water conduit to an existing water faucet, and a shower head for dispensing water supplied by the water conduit. Alternatively, the means for introducing a flow of water includes a shower head, a hot water conduit for supplying hot water to the shower head, and a cold water conduit for introducing cold water to the shower head.

If desired, the apparatus may be set on wheels to facilitate movement of the apparatus. Alternatively, the apparatus may be configured for a more permanent installation. A catch pan positionable below the through opening of the body compartment may also be provided to contain bodily waste passed by the occupant when the apparatus is not positioned over the toilet bowl.

The apparatus may further include a door defining a portion of the upstanding sides to facilitate ingress to and egress from the apparatus.

BRIEF DESCRIPTION OF THE DRAWINGS

Preferred embodiments of the invention will now be described in further detail. Other features, aspects, and advantages of the present invention will become better understood with regard to the following detailed description, appended claims, and accompanying drawings (which are not to scale) where:

DETAILED DESCRIPTION OF THE PREFERRED EMBODIMENT(S)

Figure 1:
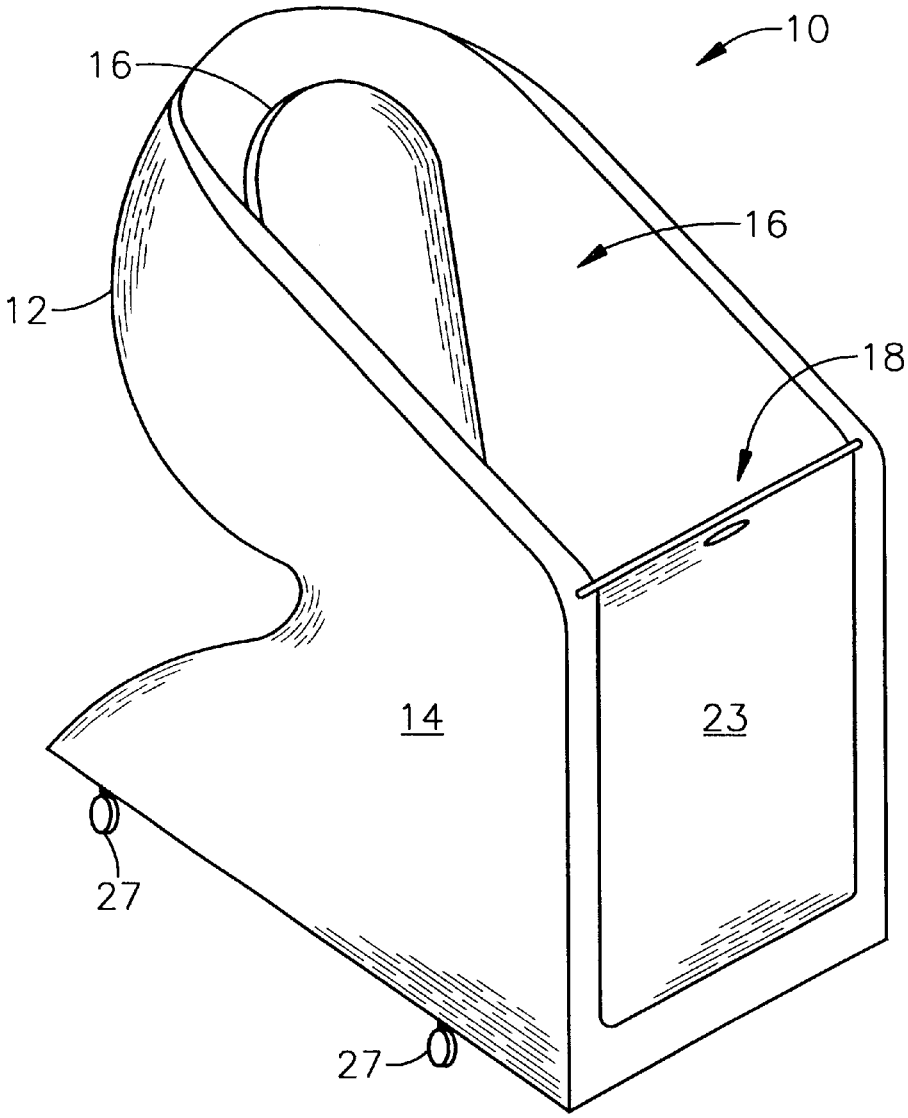
FIG. 1 is an elevated view of a shower apparatus according to the invention.

Preferred embodiments of the present invention will now be described with reference to the accompanying drawings, wherein like reference characters designate like or similar parts throughout. The terminology used herein is intended to be interpreted in its broadest reasonable manner, even though it is being utilized in conjunction with a detailed description of certain specific preferred embodiments of the present invention. This is further emphasized below with respect to some particular terms used herein. Any terminology intended to be interpreted by the reader in any restricted manner will be overtly and specifically defined as such in this specification.

Figure 2:
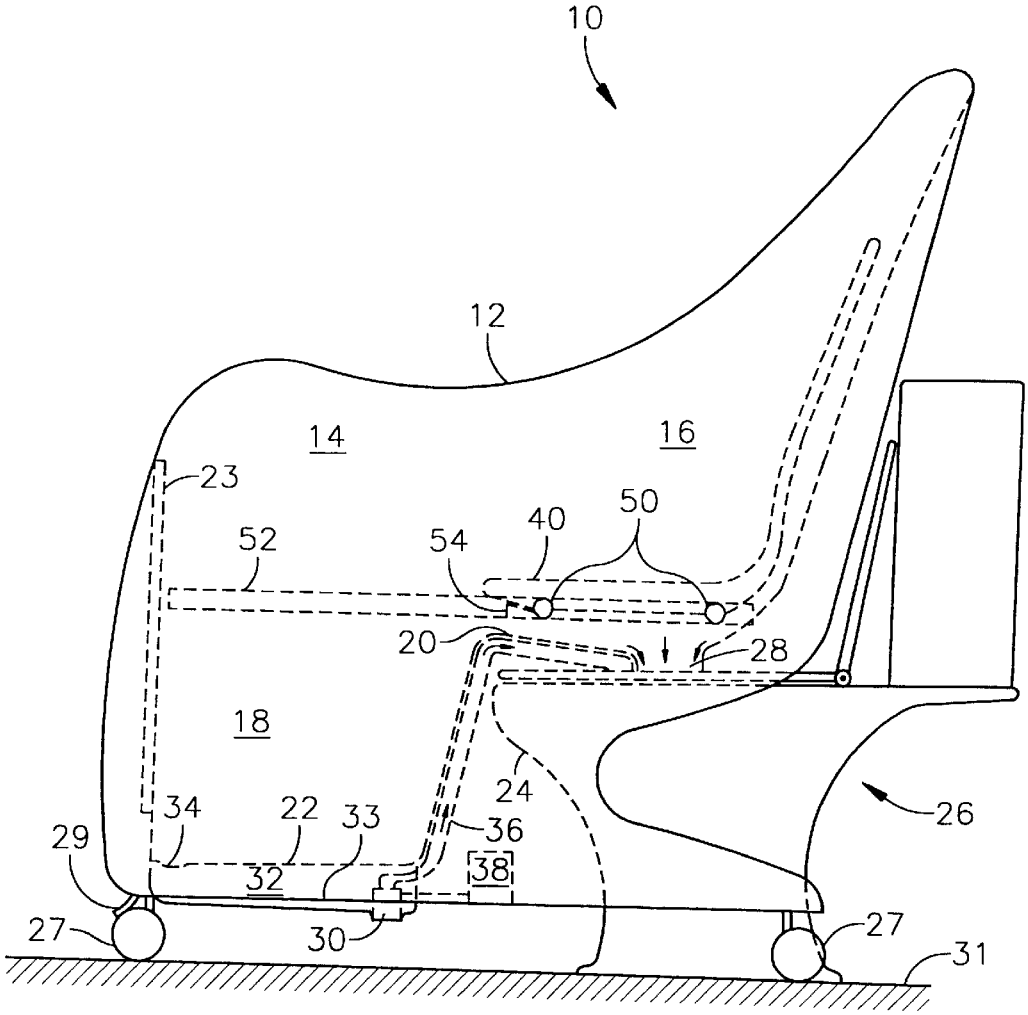
FIG. 2 is a side view of the apparatus of FIG. 1.
Figure 3:
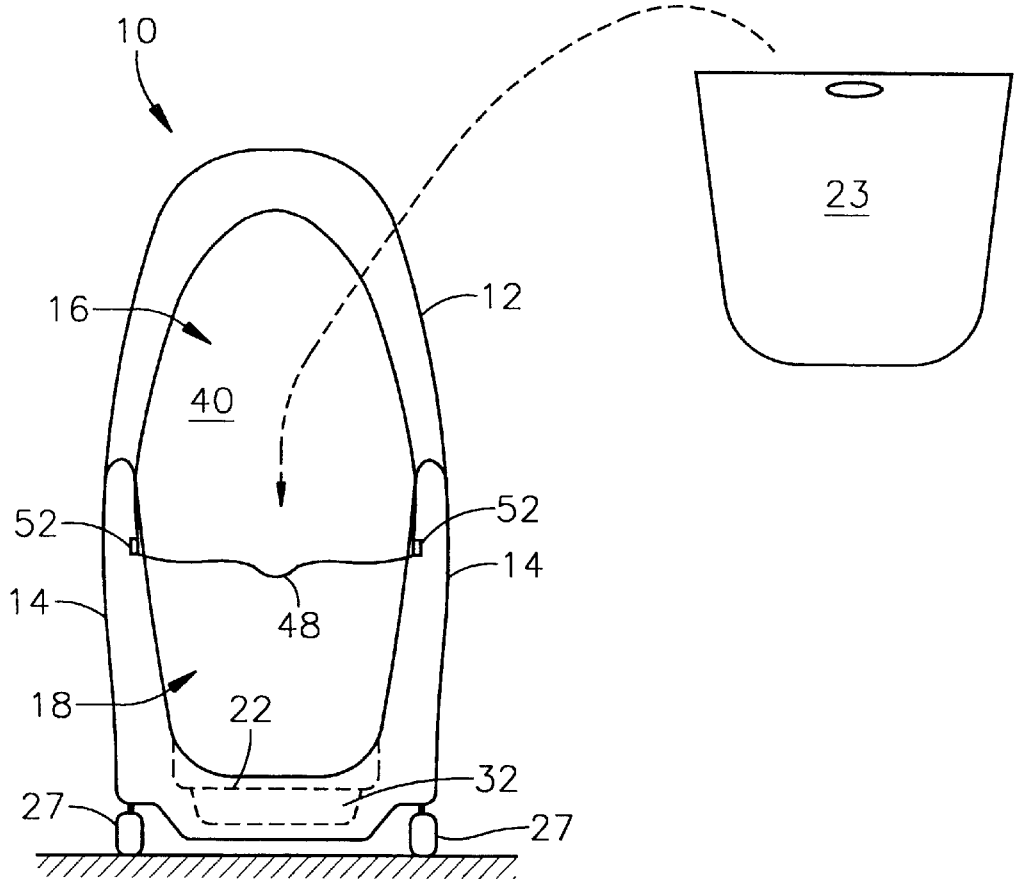
FIG. 3 is a front view of the apparatus of FIG. 1.

FIGS. 1–3 illustrate a shower apparatus 10 for a seated occupant. The apparatus 10 includes a tub 12 having upstanding sides 14 and a tub bottom. The tub 10, which is preferably fabricated from fiberglass with a water resistant finish, such as gelcoat, includes a body compartment 16 for receiving the torso of the occupant and a foot compartment 18 for receiving the feet of the occupant. The body compartment 16 includes a body compartment bottom 20 defining a first portion of the tub bottom, and the foot compartment 18 includes a foot compartment bottom 22 defining a second portion of the tub bottom. The foot compartment bottom 22 is preferably angled to facilitate movement of water out of the foot compartment 18. A door 23 defining a portion of the upstanding sides 14 is provided to facilitate ingress and egress by the shower occupant. In a preferred embodiment, the door 23 slides into its closed position (as shown in FIG. 1) by way of slots formed in the tub 10.

As shown in FIG. 2, the apparatus 10 is configured to be positionable over the bowl 24 of a stationary floor toilet 26. To facilitate movement of the apparatus 10, casters, rollers, or some other suitable form of wheels 27 are provided. One or more brakes 29 (FIG. 2) may be provided to inhibit inadvertent movement of the apparatus 10. Alternatively, the apparatus 10 is not equipped with wheels 27 and may, if desired, be installed in a permanent or semi-permanent manner with the apparatus 10 being bolted to the floor 31 or otherwise anchored so as to inhibit movement of the apparatus 10.

A through opening 28 formed in the body compartment bottom 20 allows for water to drain by gravity feed from the body compartment 16 into the toilet bowl 24. To facilitate the draining of water out of the body compartment 16, the body compartment bottom 20 is preferably angled downwardly toward through opening 28. Water which collects in the foot compartment 18 is moved into the toilet by use of a pump 30. Although various types of pumps and pump configurations may be employed in the practice of the invention to move water from the foot compartment 18 into the toilet bowl 24, in a preferred embodiment as shown in FIG. 2, a sump 32 is provided to contain water that is then pumped into the toilet bowl 24. A drain 34 positioned in the foot compartment bottom 22 allows water to drain by gravity feed from the foot compartment 18 into the sump 32. As previously described, the foot compartment bottom 22 is preferably angled downwardly toward the drain 34 to facilitate movement of water out of the foot compartment 18. Likewise, the sump bottom is also angled downwardly toward the pump 30 to facilitate movement of water out of the sump 32. Water collected in the sump 32 is moved by the pump 30 through pump outlet conduit 36 into the toilet bowl 24.

As described above, the pump 30 and its installation may be of any type and configuration that is operable to move water from the foot compartment 18 or sump 32 into the toilet bowl 24. In the preferred embodiment shown in FIG. 2, the operation of pump 30 is automatic as the pump 30 senses the presence of water in the sump 32 and activates itself to move the water into the toilet bowl 24. Alternatively, the pump 30 may be manually activated, such as by use of a switch which turns the pump on and off. The pump 30 shown in FIG. 2 receives electrical power from an onboard battery 38, which is preferably a rechargeable battery. Alternatively, electrical power for pump operation is obtained from an existing wall outlet with the requisite transformer or other power conditioning components being provided (preferably onboard the apparatus 10) to condition the supplied power to a level that is useable by the pump 30.

The pump 30 and its installation may also be configured to move water out of the foot compartment 18 and into the toilet bowl 24 without the use of a sump 32. For example, the pump 30 and its installation may be such that the pump 30 moves water out of the foot compartment 18 by way of a drain conduit having one end in fluid communication with the foot compartment 18 and the other end positioned adjacent the toilet bowl 24.

Figure 4:
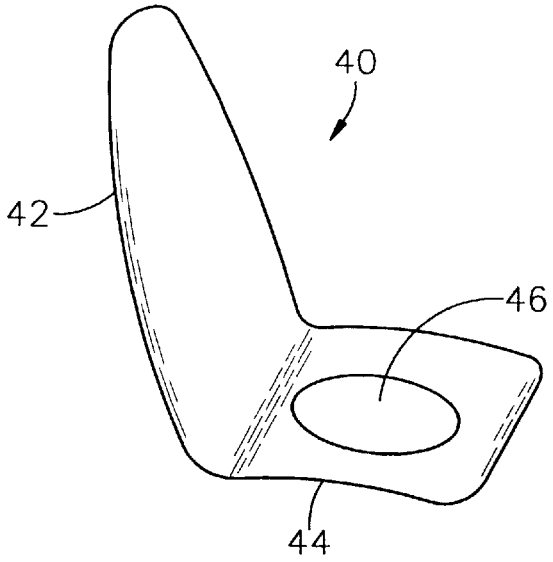
FIG. 4 is an elevated view of a seat according to the invention.

The apparatus 10 is configured to receive the occupant in a seated position. In this regard, a seat 40 is provided. As shown in FIG. 4, the seat 40 includes a back 42 and a bottom 44. As is often the case with an elderly occupant, warm shower water can cause a relaxing of the body with resultant incontenant release of bodily waste. To accommodate such events, the seat bottom 44 is provided with a through opening 46 so that body waste is able to pass through the seat 40, through the through opening 28 formed in the body compartment bottom 20, and into the toilet bowl 24. Through opening 46 also allows for the passage of shower water through the seat 40 and into the toilet bowl 24. A downward turned portion 48 of the seat 40 allows for access to the perineal area of the occupant during showering.

The seat 40 is preferably moveable to enhance ingress and egress by the occupant. In a preferred embodiment as shown in FIG. 2, this is accomplished by making the seat 40 slidable. The seat 40 is made slidable in a preferred embodiment by attaching the seat 40 to rollers 50 that are guided by guides 52 positioned at opposed sides of the tub 12. In a preferred embodiment, the guides 52 are in the form of channels within which the rollers 50 are captured. Configured in this manner, the seat 40 can be moved forward toward the foot compartment 18 to receive the occupant. Once the occupant is seated, the seat 40 and its occupant can be moved back toward the body compartment 16 in the position shown in FIG. 2. Preferably, a releasable locking mechanism 54 is employed to prevent inadvertent movement of the seat 40. The locking mechanism 54, which may be of any type suitable for preventing movement of the seat 40, is particularly useful for preventing the seat 40 from rolling back toward the body compartment 16 when the occupant is entering and exiting the apparatus 10.

Figure 5:
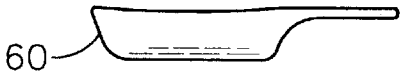
FIG. 5 is a side view of a catch pan according to the invention.

In use, the occupant may enter and exit the apparatus 10 when it is positioned over a toilet 26. Alternatively, if the apparatus is equipped with wheels 27, the occupant may enter and exit the apparatus 10 at a location remote from the toilet 26, such as the occupant's room in a nursing home or other assisted care facility. During transport to and from the remote location, a pan 60 (FIG. 5) may be utilized to contain bodily waste passed during transported. The pan 60 may be any type of container that can be removably secured to the apparatus 10 adjacent the through opening 28 formed in the body compartment bottom 20 so as to contain bodily waste passing through the through opening 28.

Figure 6:
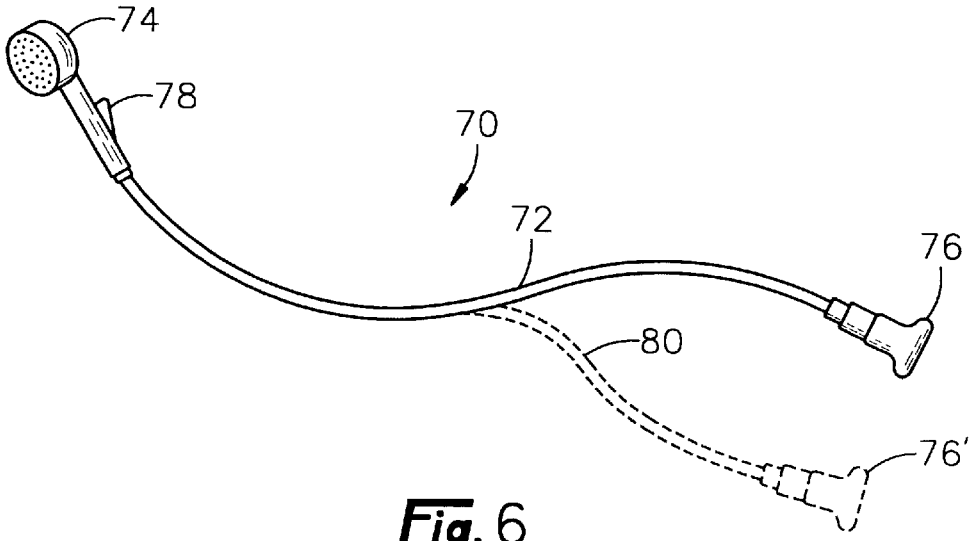
FIG. 6 is a view of a shower head and attached conduit according to the invention.

Various methods may be employed to introduce water into the tub 12 for showering/bathing operations. In a preferred embodiment, water for showering/bathing is supplied by a conventional faucet having hot and cold water valves, such as an existing sink faucet. FIG. 6 illustrates a preferred configuration of a water delivery apparatus 70 for supplying shower water from an existing sink faucet. The water delivery apparatus 70 includes a flexible hose 72 for conducting water from the sink faucet to a shower head 74 which broadcasts the supplied water for showering. The hose may be of any desired length, so long as the length is sufficient to conduct the water from the sink faucet to the tub 12. An end fitting 76, which is preferably of the quick connect variety, is attached to one end of the hose 72 to facilitate attachment of the apparatus 70 to the sink faucet. After attachment to the sink faucet, the water is turned on at the sink and allowed to flow into and through the hose 72. Water temperature is controlled at the sink by opening/closing the hot and cold water supply lines as needed. The shower head 74 preferably includes a switch 78 for controlling the flow of water out of the shower head 74. Alternatively, the shower head 74 is configured to be always open to flow.

For sinks having separate hot and cold water faucets, a second length of hose 80 (shown in phantom in FIG. 6) having its own end fitting 76' is provided with each end fitting 76, 76' being connected to one of the faucets. In this configuration, hose 80 is integrated with hose 72 to provide a mixing of the hot and cold water before it exits the shower head 74.

In addition to sinks, other sources of shower water may be utilized in the practice of the invention. For example, the faucet of an existing conventional bathtub may be used to supply water to the shower apparatus 10. Similarly, the shower head of a conventional shower may be utilized as a source of water. Alternatively, dedicated water lines may be plumbed directly to the apparatus 10 along with the requisite water control interface(s) to control both temperature and flow.

The foregoing description details certain preferred embodiments of the present invention and describes the best mode contemplated. It will be appreciated, however, that no matter how detailed the foregoing description appears, the invention can be practiced in many ways without departing from the spirit of the invention. Therefore, the above mentioned description is to be considered exemplary, rather than limiting, and the true scope of the invention is that defined in the following claims and any equivalents thereof.

What is claimed is:

1. A shower apparatus for a seated occupant, the apparatus comprising:

a tub having a plurality of upstanding sides and a tub bottom, said tub further including:

a body compartment for receiving the torso of an occupant in a seated position, said body compartment including a body compartment bottom defining a first portion of the tub bottom, said body compartment bottom including a through opening positionable over the bowl of a stationary floor toilet;

a seat for receiving the occupant in a seated position, said seat having a through opening positionable above the through opening in the body compartment bottom; and a foot compartment for receiving the feet of the occupant, said foot compartment including a foot compartment bottom defining a second portion of the tub bottom, said foot compartment bottom being at a level below the top of said toilet bowl; and means for moving water from the foot compartment into the toilet bowl.

2. The shower apparatus of claim 1, further comprising means for introducing a flow of water into said tub.

3. The shower apparatus of claim 2 wherein said means for introducing includes:

a water conduit having an end fitting for attachment of the water conduit to an existing water faucet; and a shower head for dispensing water supplied by the water conduit.

4. The shower apparatus of claim 2 wherein said means for introducing includes:

a shower head;

a hot water conduit for supplying hot water to the shower head; and a cold water conduit for supplying cold water to the shower head.

5. The shower apparatus of claim 1 wherein said means for moving includes:

a drain opening positioned within the foot compartment for draining water from the foot compartment by gravity;

a sump for receiving water drained from the foot compartment;

a pump for moving water out of the sump; and a pump conduit having a first end connected to the pump and a second end positioned adjacent the toilet bowl to conduct water moved by the pump into the toilet bowl.

6. The shower apparatus of claim 1 wherein said means for moving includes:

a drain conduit having a first end in fluid communication with the foot compartment and a second end adjacent the toilet bowl; and a pump for moving water from the foot compartment into the toilet bowl via said drain conduit.

7. The shower apparatus of claim 1, further comprising a plurality of wheels attached to the apparatus to facilitate movement of the apparatus.

8. The shower apparatus of claim 1 wherein said body compartment bottom is angled to facilitate gravitational movement of water within the body compartment to the through opening in the body compartment.

9. The shower apparatus of claim 1, further comprising a catch pan positionable below the through opening of the body compartment.

10. The shower apparatus of claim 1, further comprising a door defining a portion of said upstanding sides to facilitate ingress to and egress from the apparatus.

11. A mobile shower apparatus for a seated occupant, the apparatus comprising:

a tub having a plurality of upstanding sides and a tub bottom, said tub further including:

a body compartment for receiving the torso of an occupant in a seated position, said body compartment including a body compartment bottom defining a first portion of the tub bottom, said body compartment bottom including a through opening positionable over the bowl of a stationary floor toilet;

a seat for receiving the occupant in a seated position, said seat having a through opening positionable above the through opening in the body compartment bottom; and a foot compartment for receiving the feet of the occupant, said foot compartment including a foot compartment bottom defining a second portion of the tub bottom, said foot compartment bottom being at a level below the top of said toilet bowl;

means for moving water from the foot compartment into the toilet bowl; and a plurality of wheels attached to the apparatus to facilitate movement of the apparatus.

12. The shower apparatus of claim 11, further comprising means for introducing a flow of water into said tub.

13. The shower apparatus of claim 12 wherein said means for introducing includes:

a water conduit having an end fitting for attachment of the water conduit to an existing water faucet; and a shower head for dispensing water supplied by the water conduit.

14. The shower apparatus of claim 12 wherein said means for introducing includes:

a shower head;

a hot water conduit for supplying hot water to the shower head; and a cold water conduit for supplying cold water to the shower head.

15. The shower apparatus of claim 11 wherein said means for moving includes:

a drain opening positioned within the foot compartment for draining water from the foot compartment by gravity;

a sump for receiving water drained from the foot compartment;

a pump for moving water out of the sump; and a pump conduit having a first end connected to the pump and a second end positioned adjacent the toilet bowl to conduct water moved by the pump into the toilet bowl.

16. The shower apparatus of claim 11 wherein said means for moving includes:

a drain opening positioned within the foot compartment;

a drain conduit having a first end connected to said drain opening and a second adjacent the toilet bowl; and a pump for moving water from the foot compartment into the toilet bowl via said drain conduit.

17. The shower apparatus of claim 11 wherein said body compartment bottom is angled to facilitate gravitational movement of water within the body compartment to the through opening in the body compartment.

18. The shower apparatus of claim 11, further comprising a door defining a portion of said upstanding sides to facilitate ingress to and egress from the apparatus.

19. A mobile shower apparatus for a seated occupant, the apparatus comprising:

a tub having a plurality of upstanding sides and a tub bottom, said tub further including:

a body compartment for receiving the torso of an occupant in a seated position, said body compartment including a body compartment bottom defining a first portion of the tub bottom, said body compartment bottom including a through opening positionable over an existing toilet bowl;

a seat for receiving the occupant in a seated position, said seat having a through opening positionable above the through opening in the body compartment bottom; and a foot compartment for receiving the feet of the occupant, said foot compartment including a foot compartment bottom defining a second portion of the tub bottom, said foot compartment bottom being at a level below the top of said toilet bowl;

means for introducing a flow of water into said tub;

a drain opening positioned within the foot compartment for draining water from the foot compartment by gravity;

a sump for receiving water drained from the foot compartment;

a pump for moving water out of the sump;

a pump conduit having a first end connected to the pump and a second end positioned adjacent the toilet bowl to conduct water moved by the pump into the toilet bowl; and a plurality of wheels attached to the apparatus to facilitate movement of the apparatus.

20. The shower apparatus of claim 19 wherein said means for introducing includes:

a water conduit having an end fitting for attachment of the water conduit to an existing water faucet; and a shower head for dispensing water supplied by the water conduit.

21. The shower apparatus of claim 19 wherein said means for introducing includes:

a shower head;

a hot water conduit for supplying hot water to the shower head; and a cold water conduit for supplying cold water to the shower head.

22. The shower apparatus of claim 19 wherein said body compartment bottom is angled to facilitate gravitational movement of water within the body compartment to the through opening in the body compartment.

23. The shower apparatus of claim 19, further comprising a door defining a portion of said upstanding sides to facilitate ingress to and egress from the apparatus.

24. A shower system comprising:

a stationary floor toilet having a toilet bowl;

a mobile shower unit including:

a tub having a plurality of upstanding sides and a tub bottom, said tub further including:

a body compartment for receiving the torso of an occupant in a seated position, said body compartment including a body compartment bottom defining a first portion of the tub bottom, said body compartment bottom including a through opening positionable over an existing toilet bowl;

a seat for receiving the occupant in a seated position, said seat having a through opening positionable above the through opening in the body compartment bottom; and a foot compartment for receiving the feet of the occupant, said foot compartment including a foot compartment bottom defining a second portion of the tub bottom, said foot compartment bottom being at a level below the top of said toilet bowl;

means for introducing a flow of water into said tub;

means for moving water from the foot compartment into the toilet bowl; and a plurality of wheels for rolling the shower unit into position over said stationary floor toilet.

25. The shower system of claim 24 wherein said means for introducing includes:

a water conduit having an end fitting for attachment of the water conduit to an existing water faucet; and a shower head for dispensing water supplied by the water conduit.

26. The shower system of claim 24 wherein said means for introducing includes:

a shower head;

a hot water conduit for supplying hot water to the shower head; and a cold water conduit for supplying cold water to the shower head.

27. The shower system of claim 24 wherein said means for moving includes:

a drain opening positioned within the foot compartment for draining water from the foot compartment by gravity;

a sump for receiving water drained from the foot compartment;

a pump for moving water out of the sump; and a pump conduit having a first end connected to the pump and a second end positioned adjacent the toilet bowl to conduct water moved by the pump into the toilet bowl.

28. The shower system of claim 24 wherein said means for moving includes:

a drain opening positioned within the foot compartment;

a drain conduit having a first end connected to said drain opening and a second end adjacent the toilet bowl; and a pump for pumping water from the foot compartment into said toilet bowl via said drain conduit.

29. The shower system of claim 24, further comprising a door defining a portion of said upstanding sides to facilitate ingress to and egress from the apparatus.

30. The shower system of claim 24, further comprising a releasable brake for inhibiting movement of said shower unit.

* * * * *